US012698911B2

(12) United States Patent
Hokanson et al.

(10) Patent No.: US 12,698,911 B2
(45) Date of Patent: Aug. 4, 2026

(54) FRESH AIR VENTILATION CONTROL SYSTEM

(71) Applicant: Field Controls LLC, Kinston, NC (US)

(72) Inventors: Eric A. Hokanson, Kinston, NC (US); Timothy K. Begoske, Brighton, MI (US); Mark R. Lundberg, Greenville, NC (US)

(73) Assignee: Field Controls LLC, Kinston, NC (US)

( * ) Notice: Subject to any disclaimer, the term of this patent is extended or adjusted under 35 U.S.C. 154(b) by 0 days.

(21) Appl. No.: 18/225,507

(22) Filed: Jul. 24, 2023

(65) Prior Publication Data

US 2023/0366573 A1 Nov. 16, 2023

Related U.S. Application Data

(62) Division of application No. 16/104,553, filed on Aug. 17, 2018, now abandoned.

(Continued)

(51) Int. Cl.
*F24F 11/00* (2018.01)
*F24F 11/52* (2018.01)

(Continued)

(52) U.S. Cl.
CPC ..... *F24F 11/0001* (2013.01); *F24F 11/52* (2018.01); *F24F 11/61* (2018.01);

(Continued)

(58) Field of Classification Search
CPC ..... F24F 11/0001; F24F 2110/10; F24F 2110/20; F24F 11/52; F24F 11/61; F24F 11/755

(Continued)

(56) References Cited

U.S. PATENT DOCUMENTS 2,193,923 A * 3/1940 Hillen ..... F24F 11/30 165/223
3,946,575 A * 3/1976 Barr ..... F24F 11/30 62/262

(Continued)

FOREIGN PATENT DOCUMENTS

DE 102015203806 A1 * 9/2016 ..... F24F 11/30
KR 100939281 B1 * 1/2010 ..... F24F 11/0001
WO WO-2017127431 A1 * 7/2017 ..... F24F 11/77

OTHER PUBLICATIONS

Office action received for Canadian Patent Application No. 3015386, mailed on Dec. 3, 2024, 11 pages.

*Primary Examiner* — Michael G Hoang
*Assistant Examiner* — Frances F. Hamilton
(74) *Attorney, Agent, or Firm* — Shook, Hardy & Bacon L.L.P.

(57) ABSTRACT

This disclosure relates to a fresh air ventilation (FAV) controller. The FAV controller may include multiple input devices for setting a target fresh air ventilation flow rate (FAVFR), an operating FAVFR for an air handler, an operating FAVFR of a first ventilation appliance, an operating FAVFR of a second ventilation appliance. The FAV controller further includes electric interfaces adapted to couple to the air handler and a thermostat for controlling the air handler, a sensor for monitoring an operation of the first ventilation appliance, the second ventilation appliance, a thermometer for monitoring temperature of fresh air in a ventilation path to the air handler, and a motorized damper disposed in the fresh air ventilation path. The FAV controller may be configured to monitor operation times of the air handler, the first ventilation appliance, the second ventilation appliance, and the thermometer via the electric interfaces, and to control the air handler and the motorized (Continued)

damper, and/or the second ventilation appliance via the electric interfaces.

19 Claims, 9 Drawing Sheets

Related U.S. Application Data

(60) Provisional application No. 62/550,878, filed on Aug. 28, 2017.

(51) Int. Cl.
*F24F 11/61* (2018.01)
*F24F 11/755* (2018.01)
*F24F 110/10* (2018.01)
*F24F 110/20* (2018.01)

(52) U.S. Cl.
CPC ..... *F24F 11/755* (2018.01); *F24F 2011/0002* (2013.01); *F24F 2110/10* (2018.01); *F24F 2110/20* (2018.01)

(58) Field of Classification Search
USPC ..... 454/258
See application file for complete search history.

(56) References Cited

U.S. PATENT DOCUMENTS 3,979,922 A * 9/1976 Shavit ..... G05B 13/02 165/251
4,245,779 A 1/1981 Ardiente
4,293,027 A * 10/1981 Tepe ..... G05D 23/1931 165/250
4,362,026 A * 12/1982 Miller ..... F25D 16/00 165/251
5,082,173 A * 1/1992 Poehlman ..... F24F 11/80 236/11
5,547,017 A * 8/1996 Rudd ..... F24F 11/67 165/244
5,564,626 A * 10/1996 Kettler ..... F24F 8/10 55/471
5,626,288 A * 5/1997 Huber ..... F24F 11/76 165/248
5,881,806 A * 3/1999 Rudd ..... F24F 3/14 165/250
6,926,602 B1 * 8/2005 Reese ..... E04B 1/7092 236/44 C
7,798,418 B1 * 9/2010 Rudd ..... F24F 11/0001 454/258
7,979,163 B2 * 7/2011 Terlson ..... F24F 11/46 700/83
7,979,164 B2 7/2011 Garozzo et al.
8,185,244 B2 5/2012 Wolfson
8,195,335 B2 * 6/2012 Kreft ..... F24F 7/08 62/186
8,702,482 B2 4/2014 Helt et al.
8,725,300 B2 5/2014 Desrochers
9,115,907 B2 8/2015 Helt et al.
9,237,681 B2 * 1/2016 Slessman ..... H05K 7/20836
9,322,568 B2 4/2016 Aycock
9,874,366 B2 1/2018 Grefsheim
10,001,289 B2 6/2018 Mowris
10,408,487 B1 9/2019 Berman
10,488,070 B1 * 11/2019 Wolfson ..... F24F 11/0001
10,520,214 B2 12/2019 Motodani et al.
10,551,813 B2 2/2020 Burt et al.
10,782,042 B2 9/2020 Funada et al.
10,788,225 B2 9/2020 Takeda et al.
2003/0181158 A1 * 9/2003 Schell ..... F24F 11/0001 454/229
2004/0188532 A1 * 9/2004 Weimer ..... F24F 11/0001 236/51
2005/0156052 A1 * 7/2005 Bartlett ..... F24F 11/0001 236/49.3
2006/0004492 A1 * 1/2006 Terlson ..... F24F 11/30 700/276
2006/0158051 A1 7/2006 Bartlett et al.
2010/0044448 A1 * 2/2010 Wolfson ..... F24F 7/003 165/244
2010/0211224 A1 8/2010 Keeling et al.
2010/0243749 A1 * 9/2010 Matsui ..... F24F 11/0001 236/44 A
2010/0298992 A1 * 11/2010 Knyazev ..... F24F 11/62 700/277
2011/0151766 A1 * 6/2011 Sherman ..... F24F 11/0001 454/239
2011/0223850 A1 9/2011 Narayanamurthy et al.
2012/0190294 A1 7/2012 Heidel et al.
2012/0252345 A1 10/2012 Wolfson
2012/0286715 A1 11/2012 Nakajima et al.
2013/0180700 A1 * 7/2013 Aycock ..... F24F 11/77 454/239
2014/0041401 A1 2/2014 Douglas
2015/0253025 A1 9/2015 Helt et al.
2015/0285524 A1 * 10/2015 Saunders ..... F24F 11/62 454/239
2016/0033155 A1 2/2016 Grefsheim
2016/0169544 A1 * 6/2016 Fischer ..... F24F 3/044 165/250
2016/0209070 A1 * 7/2016 Hrejsa ..... F24F 11/523
2017/0159963 A1 * 6/2017 Matsugi ..... F24F 11/74
2017/0299212 A1 * 10/2017 Svitak ..... F24F 11/77
2017/0321917 A1 * 11/2017 Nickel ..... F24F 11/76
2017/0321922 A1 11/2017 Takahashi et al.
2017/0347499 A1 * 11/2017 Ross ..... F24F 11/77
2018/0299150 A1 10/2018 Ajax et al.
2020/0188832 A1 * 6/2020 Woods ..... B01D 46/58
2021/0071891 A1 3/2021 Ferrere, Jr. et al.
2021/0172632 A1 * 6/2021 Saunders ..... F24F 11/64
2022/0412588 A1 * 12/2022 Stevenson ..... F24F 7/007
2025/0164139 A1 * 5/2025 Kim ..... F24F 11/65

* cited by examiner

FRESH AIR VENTILATION CONTROL SYSTEM

CROSS REFERENCES

This application is a divisional of U.S. Ser. No. 16/104,553 (filed Aug. 17, 2018), which claims the priority benefit of U.S. Provisional Application No. 62/550,878 (filed on Aug. 28, 2017). Each of the aforementioned applications is incorporated herein by reference in its entirety.

TECHNICAL FIELD

This disclosure relates to fresh air ventilation control (FAVC) and directs particularly to a versatile FAVC device and method for balanced and constrained ventilation.

BACKGROUND

Air-conditioned and sealed residential or commercial constructions may be required under applicable building codes to implement proper fresh air ventilation (FAV). FAV is traditionally achieved via a fresh air duct connected to a return path of a central air handler for drawing outside air into the building when a central fan of the central air handler is activated. Alternatively or additionally, FAV may be provided via unsealed openings, windows/doors that are intermittently opened, and/or the fresh air duct when other exhaust appliances, such as a bathroom exhaust fan, a water heater, a dryer, a fireplace, and a range hood, are in operation. The ventilation by the central fan and the ventilation by other exhaust appliances, however, are independent of one another.

SUMMARY

This disclosure is directed to a FAVC device and method for balanced and constrained fresh air ventilation.

In one implementation, an FAV controller is disclosed. The FAV controller may include a first input device for setting a first fresh air ventilation flow rate (FAVFR) as a target for a continuous fresh air ventilation, a second input device for setting a second FAVFR of an air handler when in operation, and a third input device for setting a third FAVFR of a first ventilation appliance when in operation. The FAV controller may further include a first electric interface adapted to couple to the air handler and a thermostat for controlling the air handler, and a second electric interface adapted to couple to a sensor for monitoring an operation of the first ventilation appliance. The FAV controller may further include a system circuitry configured to, in a consecutive first cycle and second cycle of multiple control cycles, monitor an effective FAVFR of the first ventilation appliance during the first cycle based on the third FAVFR and an operation time of the first ventilation appliance during the first cycle measured via the second electric interface; monitor, via the first electric interface, an effective FAVFR of the air handler during the second cycle based on the second FAVFR and an operation time of the air handler during the second cycle under the control of the thermostat; and generate a control signal for obtaining supplemental fresh air ventilation during the second cycle when a sum of the effective FAVFR of the ventilation appliance and the effective FAVFR of the air handler is less than the first FAVFR.

In an alternative implementation, another FAV controller is disclosed. The FAV controller may include first input device for setting a first fresh air ventilation flow rate (FAVFR) as a target for a continuous fresh air ventilation, a second input device for setting a second FAVFR of an air handler when in operation, a third input device for setting a third FAVFR of a first ventilation appliance when in operation, and a fourth input device for setting a fourth FAVFR of a second ventilation appliance when in operation. The FAV controller may further include a first electric interface adapted to couple to the air handler and a thermostat for controlling the air handler, a second electric interface adapted to couple to a sensor for monitoring an operation of the first ventilation appliance, a third electric interface adapted to couple to the second ventilation appliance, a fourth electric interface adapted to couple to a thermometer for monitoring temperature of fresh air in a ventilation path coupled to a return path of the air handler, and a fifth electric interface adapted to couple to a motorized damper disposed in the fresh air ventilation path. The FAV controller may further include a system circuitry configured to monitor operation times of the air handler, the first ventilation appliance, the second ventilation appliance, and the thermometer via the first, the second, the third, and the fourth electric interfaces; and control the air handler and the motorized damper, and/or the second ventilation appliance via the first, the third, and the fifth electric interfaces.

DETAILED DESCRIPTION

Figure 1:
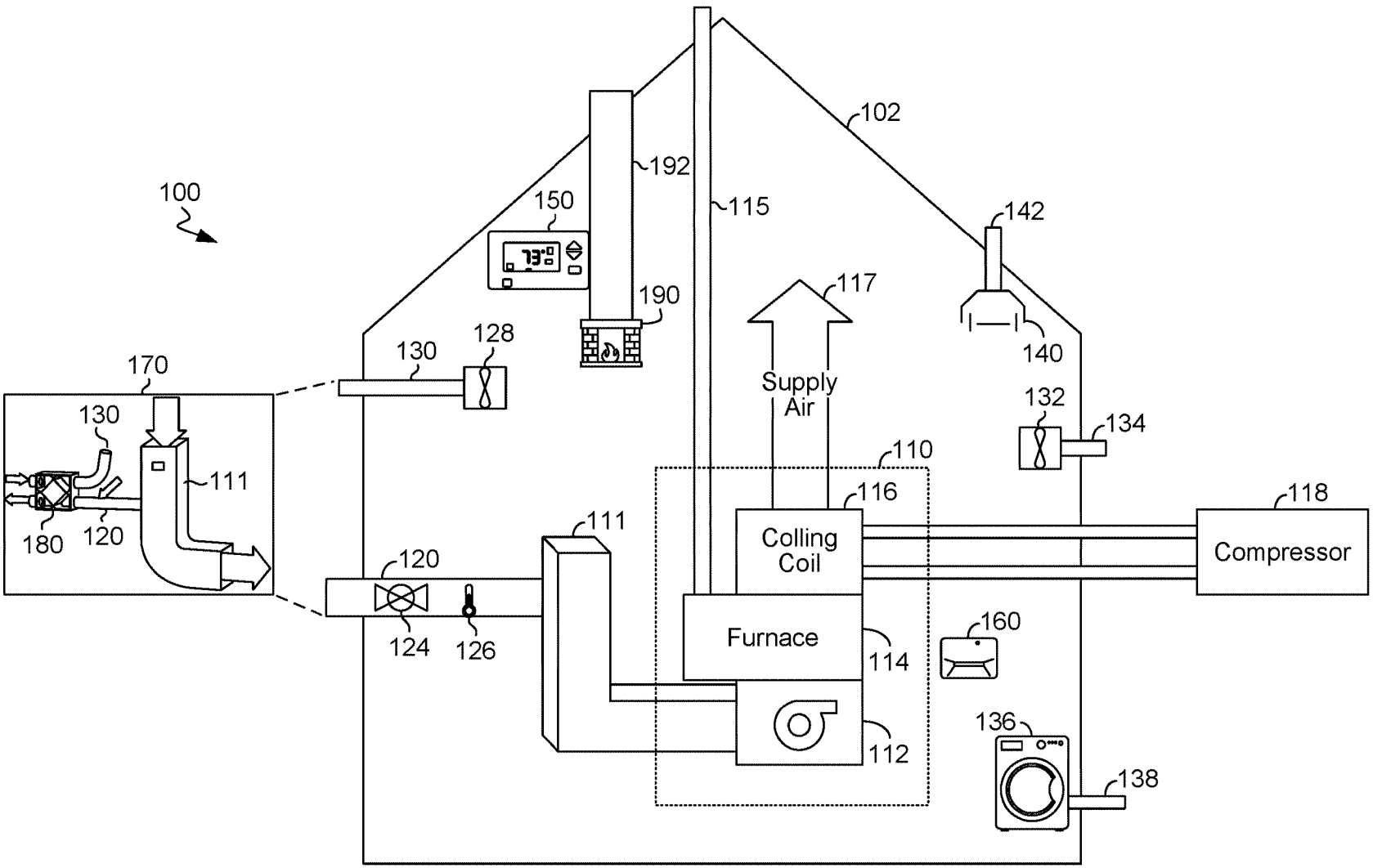
FIG. 1 shows an air handling and ventilation system in a building including an FAV controller.

Fresh air ventilation (FAV) is essential for maintaining indoor air quality in residential, commercial, industrial, and other settings. In the U.S., for example, ASHRAE (American Society of Heating, Refrigerating and Air-Conditioning Engineers) Standard 62.1 specifies various residential FAV requirements and recommendations to builders and building code designers. In particular, ASHRAE Standard 62.2 specifies an average continuous FAV flow rate recommendation of a residence according to a total floor area and number of rooms or sections. FAV may be obtained by activation of exhaust appliances such as a central air handler, water heaters, exhaust boosters, bathroom exhaust fans, a dryer, a fireplace, and a range hood. The air exhausted by these appliances may be replaced with fresh air via a window, door, and other unsealed openings, and additionally, via a FAV duct coupled to a central air handler and installed with a controllable motorized damper. Further, appliances with high exhaust flow rates or air consumptions, such as certain types of fireplaces and kitchen range hoods, may require makeup air, necessitating an installation of fresh air intake ducts by most building codes.

The various appliances above, when activated, may produce various exhaust flow rates. The activation of these devices may or may not be controllable by a central device. For example, a bathroom exhaust fan may be manually turned on and off at any time for random durations rather than being automatically controlled. On the other hand, an FAV resulting from fresh air drawn into the building by running the central air handler may be controllable by a thermostat coupled to the central air handler. Some exhaust fans may be installed with dedicated controllers that automatically turn on and off the exhaust fans based on, e.g., humidity (in a bathroom for example), temperature, and other parameters.

The FAV duct coupled to the central air handler may draw outside fresh air into an air return path of the central air handler when a central fan of the central air handler, alternatively referred to as a central air blower, is activated. In additional to the central fan for inducing FAV (as well as internal air circulation), the central air handler may further include a combination of a furnace plenum and a cooling coil or a single heat pump coil for conditioning temperature of the inside air. The cooling coil or heat pump coil may be coupled to an exterior compressor and an expansion valve for circulating refrigerant. Cooling and heating cycles may be controlled by a thermostat having a thermometer for measuring the indoor temperature. The fresh air that flows from the FAV duct into the return path of the central air handler may be excessively moist and may induce condensation in the central air handler. While the cooling coil or heat pump coil may be built to handle condensation as a norm and thus may be affected very little by humid return air, condensation on a fossil fuel based furnace plenum, however, may cause gradual life-shortening corrosion.

The disclosure below relates to FAVC devices that can be custom configured to interface with the central air handler, the thermostat, the motorized damper, and other exhaust appliances for setting, monitoring, and controlling these appliances in a holistic manner to achieve a balanced FAV that satisfies an average continuous FAV flow rate target specified by the ASHRAE Standard 62.2, subject to humidity and temperature constraints. The FAVC device disclosed below may be adapted to integrate with and control a wide range of exhaust appliances, including energy recovery ventilation (ERV) or heat recovery ventilation (HRV) systems. Further, the FAVC devices disclosed below are flexibly configured to function with a central air handler having fossil fuel based furnace plenum as well as a single heat pump coil, and to control the ventilation to protect the furnace plenum from condensation-induced corrosion. Other advantages and improvements of the disclosed FAVC devices over traditional ad hoc ventilation systems will become apparent in the detailed description below.

FIG. 1 illustrates an exemplary implementation of a residential air conditioning and FAV setting 100. Although FIG. 1 and the rest of the disclosure below use a residential setting as an example, the underlying principles discussed below are applicable to business, industrial, and other settings. As shown by FIG. 1, the air conditioning and FAV setting 100 is implemented in a residence 102 and may include a central air handler 110 coupled to a thermostat 150, one or more exhaust fans 128 and 132 with exhaust ducts 130 and 134, a clothes dryer 136 with exhaust duct 138, a kitchen range hood 140 with exhaust duct 142, a fireplace 190 (e.g., a gas log fireplace) with chimney 192, and an FAV controller 160 coupled to the afore-mentioned appliances in an exemplary manner that will be described below.

The central air handler 110 may include a port 111 for returning air from the residence to the central air handler, a port 117 for supplying and distributing air to various locations in the residence, a central fan 112, a furnace with plenum 114, a heat exchanger with cooling coil 116 coupled to a compressor for refrigerant 118 disposed outside of the residence 102. When the central fan 112 is in operation, the return air in port 111 flows through the furnace plenum 114 followed by the cooling coil 116 and is distributed throughout the residence. The furnace may be coupled to and controlled by the thermostat 150 disposed in a suitable location in the residence 102. The thermostat 150 may include temperature and humidity sensors for controlling the central air handler 110 to providing heating and cooling. The central fan 112 may operate at different speed for cooling and heating. The furnace or furnace plenum 114 may be based on combustion of fossil fuels such as oil and natural gas. The furnace thus may need to draw combustion air from the residence to be mixed with the fossil fuel. The required combustion air may be drawn into the furnace combustion chambers through a furnace grill. The combustion exhaust may be taken out of the residence via a furnace exhaust duct 115. A draft pipe from the outside of the residence to a location near the furnace for replenish combustion air may further be installed (not shown in FIG. 1).

The central air handler may be further coupled to an FAV duct 120 at the return path 111. The FAV duct 120 may be extended to exit to outside of the residence 102. A motorized damper 124 may be installed in the FAV duct 120 to facilitate the control of flow of fresh air into the return path 111 of the central air handler from the outside. The motorized damper 124 may be placed close to the exit or a vent hood of the FAV duct 120, or alternatively, may be disposed anywhere along the FAV duct 120. An outdoor temperature (ODT) sensor or thermometer 126 may be installed in the FAV duct 120 to measure the temperature of the air flowing from outside of the residence into the return path 111 of the central air handler. Sensor or thermometer 126 is referred to as an outdoor temperature sensor but does not need to be installed outdoors. The purpose of the ODT sensor 126 is to monitor the incoming fresh air temperature before being mixed with the air returning to the central air handler 110. As such, the ODT sensor 126 may be installed after the motorized damper 124 but before the location of the coupling between the FAV duct 120 and the return path 111 of the central air handler 110. For example, a ¼ inch hole may be drilled into the FAV duct 120 and the ODT sensor may be inserted into the FAV duct via the drill hole and the drill hole may then be sealed with metal duct tape.

The exhaust fans 128 and 132, for example, may be installed in bathrooms. They may be controlled by traditional manual wall switches. Alternatively and additionally, an ERV/HRV system may replace, e.g., the exhaust fan 128, the exhaust duct 130, and the FAV duct 120. For example, as shown by 170 of FIG. 1, the exhaust duct 130 of the exhaust fan 128 may be configured to exchange heat with the FAV duct 120 via a heat exchanger 180. The ERV/HRV system 170 may include separate built-in fans for exhaust air and fresh air (not shown in FIG. 1). The exhaust air in the exhaust duct 130 and the fresh air in the FAV duct 120 do not mix. They only exchange heat such that the incoming fresh air is preheated during colder weather (e.g., winters) and precooled in warmer weather (e.g., summers). In the ERV/HRV configuration, the ODT sensor 126 is preferably installed after the heat exchanger 180 on the side closer to the return path 111 of the central air handler for purposes of measuring the fresh air temperature shortly before being mixed with the return air at the return path 111 of the central air handler 110.

Other appliances such as clothes dryer 136, kitchen range hood 140, and fireplace 190, when in operation, may take air out of the residence with high flow rates. Some of these appliances, such as the fireplace 190 and/or the kitchen range hood 140 may require makeup air, which may be sufficiently supplied by natural drafting for large residence, or may require a makeup air duct in tandem operation with these appliances (not shown in FIG. 1). According to some building code, a duct heater may be further required for heating up cold makeup air through the makeup air duct (not shown in FIG. 1).

A central component of this disclosure, the FAV controller 160, monitors and controls at least some of the multiple appliances above to achieve ventilation requirements specified in the ASHRAE Standard 62.2 while maintaining quality of indoor air and protecting the furnace plenum from excessive moisture and condensation. The FAV controller 160, for example, may monitor and control the FAV periodically, e.g., in 30 minutes cycles, so that ventilation requirement is satisfied on average and in each ventilation cycle.

Figure 2:
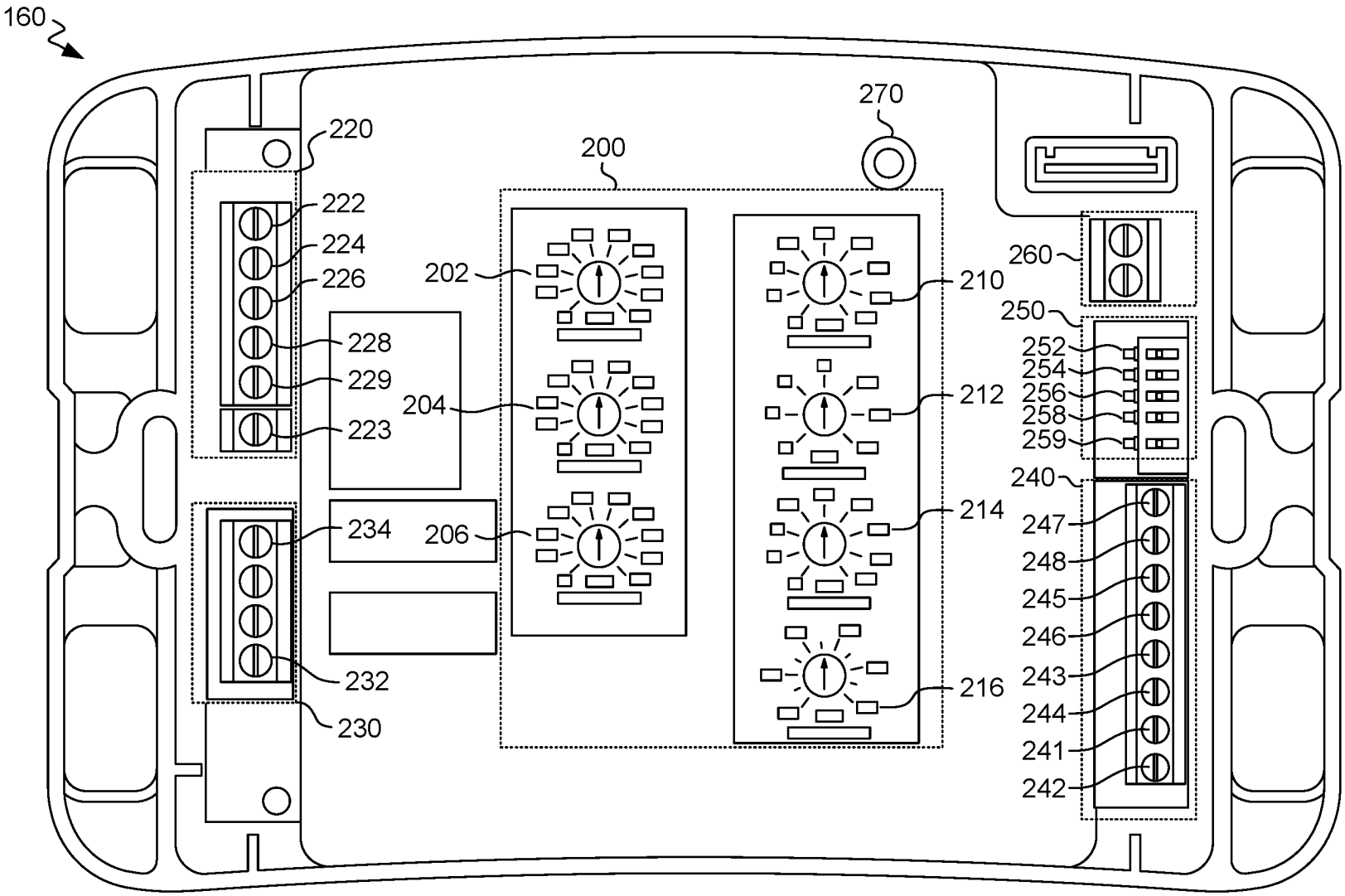
FIG. 2 illustrates an exemplary FAV controller having various electric interfaces and flow rate setting devices.

FIG. 2 shows exemplary electric interfaces and configurable setting devices that may be implemented in the FAV controller 160 of FIG. 1. The FAV controller 160 may include a plurality of flow rate setting devices (FRSDs) 200. The FRSDs 200 may be implemented as rotary dials configurable in multiple predetermined discrete levels of predetermined ranges as shown in FIG. 2, or may be implemented as continuous rotary dials. The FRSDs 200 may alternatively be implemented as one or more push buttons and one or more display panels for manipulating and displaying a set of stored data and parameters. Other suitable implementation for setting flow rates are contemplated. In one implementation, the first three FRSDs 202, 204, and 206 may be used for computing and adjusting ventilation runtime during each ventilation cycle according to the ASHRAE Standard 62.2. The ventilation cycle period, t, may be predetermined at, e.g., 30 minutes. Other predetermined values for t are contemplated. The FRSD 202, for example, may be used to set a continuous flow rate requirement or target according to the ASHRAE Standard 62.2:

$$F_{target}=0.03A_{floor}+7.5(N_{br}+1) \quad (1)$$

where $F_{target}$ is the required or target continuous ventilation rate in cfm (cubic feet per minute), $A_{floor}$ is the floor area of the residence ($ft^2$), and $N_{br}$ is the number of bedrooms (not to be less than 1) in the residence. As such, a 4-bedroom residence having 3000 $ft^2$ requires about 130 cfm ventilation on a continuous flow basis. The FRSD 202 may be set accordingly.

FRSDs 204 and 206 may be used to set operational flow rates for the central fan in heating and cooling modes, $F_{heat}$ and $F_{cool}$, respectively. The FRSDs 204 and 206 may be used to set $F_{heat}$ and $F_{cool}$ in a range of, for example, from 25 cfm up to 700 cfm. These operational flow rates may only include the flow rate of fresh air into the residence via the FAV duct 120 of FIG. 1 when the central fan is in operation. For example, flow rate of fresh air in the FAV duct 120 may be measured using a pilot tube when the central fan is in operation and the FRSDs 204 and 206 may be set at levels according to the measurements. The FRSDs 204 and 206, in conjunction of the running time of the central fan, can be used to estimate the amount of ventilation due to cooling or heating and can be further used to estimate additional ventilation flow needed in each ventilation cycle to satisfy the target continuous flow rate set in FRSD 202.

The FRSDs 210, 212, 214, and 216 may be used for setting operational flow rate of various exhaust appliances other than the central fan. As will be described in more detail later, operation of the various exhaust appliances may be monitored by the FAV controller 160 and the fresh air ventilation as a result of such operation during a ventilation cycle may be tracked by the FAV controller and credited towards and reduce ventilation required in one or more future ventilation cycles. The FRSDs 210, 212, 214, and 216 may each be configured with various flow rate-setting ranges for monitoring different types of exhaust appliances. For example, FRSD 210 may be configured as a rotary dial with multiple settable levels between 25-225 cfm for monitoring a bathroom exhaust fan. For another example, FRSD 212 may be configured as a rotary dial with multiple settable levels between 20-140 cfm for monitoring another smaller bathroom exhaust fan. The FRSD 214 may be configured as a rotary dial with multiple settable levels between 80-400 cfm for monitoring medium high flow rate exhaust appliances such as the clothes dryer 136 of FIG. 1. The FRSD 216 may be configured as a rotary dial with multiple settable levels between 100-1600 cfm for monitoring high flow rate appliances such as the kitchen range hood 140 and/or gas log fireplace 190 of FIG. 1.

As further shown in FIG. 2, the FAV controller 160 may include an electric interface 220 configured to couple to the central air handler 110 and the thermostat 150 of FIG. 1. The electric interface 220, alternatively referred to as the central air handler interface, may include a C terminal 222 for common, an R terminal 229 for providing 24 V supply, a W terminal 224 for monitoring a heating signal from the thermostat 150, a GT terminal 226 for monitoring a central fan control signal from the thermostat 150, and a GF 228 terminal for providing a fan control signal to the central air handler 110. In this exemplary implementation, the FAV controller 160 does not need to be connected to compressor or cooling signal (Y) of the thermostat 150 as the thermostat fan signal (GT, 226) in conjunction with a lack of heat signal (W, 224) will suffice to signify whether cooling is active for all central air handler configurations including central air handler based on heat pumps. The thermostat fan control signal GT 226 is passed to the GF terminal 228 though a relay contact when the FAV controller is idle or is not in control of the central fan. All terminals in the central air handler interface 220 may source from a 24V power supply of the central air handler 110 of FIG. 1.

Continuing with FIG. 2, the FAV controller 160 further includes two isolated outputs 234 (V terminal pairs) and 232 (E terminal pairs) (collectively referred to as ventilation control terminals 230) for activating/deactivating the motorized fresh air damper 124 and one or more remote relays to control one or more auxiliary exhaust fans, e.g., exhaust fans 128 and/or 132 of FIG. 1. The V terminal pairs may be alternatively referred to as a damper control interface and the E terminal pairs may be alternatively referred to as an appliance control interface. Both the V terminal pairs and E terminal pairs may be compatible with all types of ERV/HRV systems that may use dry contact or DC signals. In one implementation, both the V and E terminal pairs may be isolated from the 24V supply, and as such, one terminal of each pair may be connected to the R (24V) side of a supply transformer in order to control the motorized damper 124 or the remote relay to operate the exhaust fan 128.

The FAV controller 160 may further include an outdoor temperature (ODT) monitoring interface with terminals S (260 of FIG. 2) for coupling to the ODT sensor 126 of FIG. 1 for monitoring the temperature of ventilation air drawn into the FAV duct from the outside. In one implementation, the ODT sensor is not polarized so it does not matter which wire is connected to either of the S terminals. The FAV controller 160 may further provide a three color (Red, Green, Blue) LED 270 as a climate condition indicator to indicate condition of outside air temperature and relative humidity of the return air, as will be described in more detail below.

Continuing with FIG. 2, the FAV controller further provides appliance monitoring electric interface 240 for monitoring various exhaust appliances during each ventilation cycle. The purpose of the monitoring is to account for ventilation achieved by the various exhaust appliances and credit such ventilation to future ventilation cycles for optimizing energy usage and for preventing over ventilation. In one implementation, the appliance monitoring electric interface 240 may include four pairs of terminals, 241/242 (A1/AC1), 243/244 (A2/AC2), 245/246 (A3/AC3), and 247/248 (A4/AC4) for independently monitoring up to four exhaust appliances. Specifically, each of these terminal pairs may be connected to a current sensor in the electric path or a pressure or flow sensor in the air path of an exhaust appliance for monitoring an operation of the exhaust appliance. The current sensor, for example, may determine whether the exhaust appliance is electrically energized. The pressure sensor/airflow sensor, for another example, may determine whether the exhaust appliance is energized by detecting air pressure/airflow values or changes. The operation time of the exhaust appliance during each ventilation cycle may be tracked. The four pairs of monitoring terminals may be electrically isolated from each other. Unused pairs of monitoring terminals may be left unconnected. The four FRSDs 210, 212, 214, and 216 described above specifies the corresponding operational flow rates of the exhaust appliances monitored by the four pairs of monitoring terminals. An FRSD setting is effective only when the corresponding pair of monitoring terminals are connected to a sensor and detect operation of the corresponding exhaust appliance. In some implementation, each monitoring pair of terminals may be used to monitor a group rather than a single appliance via, e.g., multiple disjunctively connected current sensors.

The FAV controller may further include a mode selector 250 for setting various mode of ventilation control operation. In one exemplary implementation, the mode selector 250 includes four dipswitches 252, 254, 256, and 258 (positions 4, 3, 2, and 1). For example, as shown in Table 1 below, the dipswitches at positions 1 and 2 may be used for specifying a climate setting; the dipswitch at position 3 may be used for specifying a central fan circulation control mode; and the dipswitch at position 4 may be used to specify an energy mode for the FAV controller 160.

TABLE 1

| POS 1 HOT | POS2 COLD | FUNCTION |
|---|---|---|
| ON | ON | NORMAL |
| OFF | ON | COLD |
| ON | OFF | HOT |
| OFF | OFF | DISABLED |
| POS 3 | FUNCTION | |
| ON | FAN CYCLES WITH APPLIANCE #3 INPUT | |
| OFF | FAN DOES NOT CYCLE WITH APPLIANCE #3 INPUT | |
| POS 4 | FUNCTION | |
| ON | ENERGY SAVING MODE, EXHAUST FAN CONTROL, CENTRAL FAN NOT CONTROLLED BY FAVC | |
| OFF | DISABLED, FAVC CONTROLS CENTRAL FAN | |

Specifically, the climate mode specified by the dipswitches at positions 1 and 2 of the mode selector 250 may be used to determine constraints and conditions on the ventilation control by the FAV controller 160 during each ventilation cycle based on climate. The effect of these constraints and conditions will be described in more detail below. The central fan circulation control mode specified by the dipswitch at positon 3 of the mode selector 250 may be used to determine whether the FAV controller needs to bypass the thermostat fan control and force the central fan to turn on when the FAV controller detects an operation of a particular exhaust appliance. In one exemplary implementation, the central fan circulation control mode may be tied to an appliance monitored by the appliance monitoring terminals A3/AC3 (245 and 246 of FIG. 2). As such, if the dipswitch at position 3 is set to "ON", the FAV controller will bypass the thermostat and turn on the central fan via the GF terminal 228 of the central air handler interface 220 when it detects that the appliance monitored by the A3/AC3 terminals is in operation. If the dipswitch at position 3 is set to "OFF", the operation of the appliance monitored by the A3/AC3 terminals would have no effect on the operation of the central fan. This feature is useful because some high flow rate appliances such as the clothes dryer 136 of FIG. 1 may locally remove air in a particular room of the residence and it may be desirable to force the central fan to circulate and balance air in the entire residence when such a high flow rate appliance is in operation.

The energy mode set by the dipswitches at position 4 of the mode selector 250 specifies whether the FAV controller controls ventilation in a normal mode or in an energy saving mode. In the energy saving mode, for example, additional ventilation required in each ventilation cycle after taking into account the ventilation by the central fan under the control of the thermostat during heating or cooling calls may be obtained by controlling an exhaust appliance (e.g., an exhaust appliance coupled to an efficient ERV/HRV setup such as 170 of FIG. 1) by the appliance control terminals 232 (E terminals) of the FAV controller 160 without controlling the central fan. In the normal mode, the additional ventilation required in each ventilation cycle may be obtained by activating the central fan (if not activated already by the thermostat) via the GF terminal of the central air handler interface 220 in addition to activating the exhaust appliance controlled by the ventilation control terminals 232 (E terminals). In the energy saving mode, the flow rate of the appliance controlled by the E terminals may be set by the FRSD 210. Such an appliance may further be monitored by the A1/AC1 terminals corresponding to the FRSD 210. The E terminals may control more than one appliances by connecting the E terminals to multiple relays, each for activating/deactivating one appliance. In some implementations, the mode selector 250 may further include a fifth dipswitch 259 for implementing an Auto/On function. In conjunction with this function, the FAV controller may further include remote control terminals (RA and RB as part of, e.g., central air handler interface 220) that may be used by a remote control of the FAV controller (when the installed location of the FAV controller is too difficult to access directly). In particularly, the remote control terminals may be dry contact and the a remote control may connect to the remote control terminal by a timer control, a toggle switch, or the like. The remote control, when connected to the FAV controller via the remote control terminals RA and RB, would control the on/off of the FAV controller. IF the remote control terminals RA and RB is not connected to any remote control, the dipswitch 259 may function as a on/off switch for the FAV controller. In some implementations, the FAV controller may still respond to make up air function by monitoring, for example, terminals 247 and 248 for operation of appliances needing makeup air and activate ventilation regardless of whether the FAV controller is set at off state either by the remote control via the RA and RB terminals or by the dipswitch 259 directly.

Figure 3:
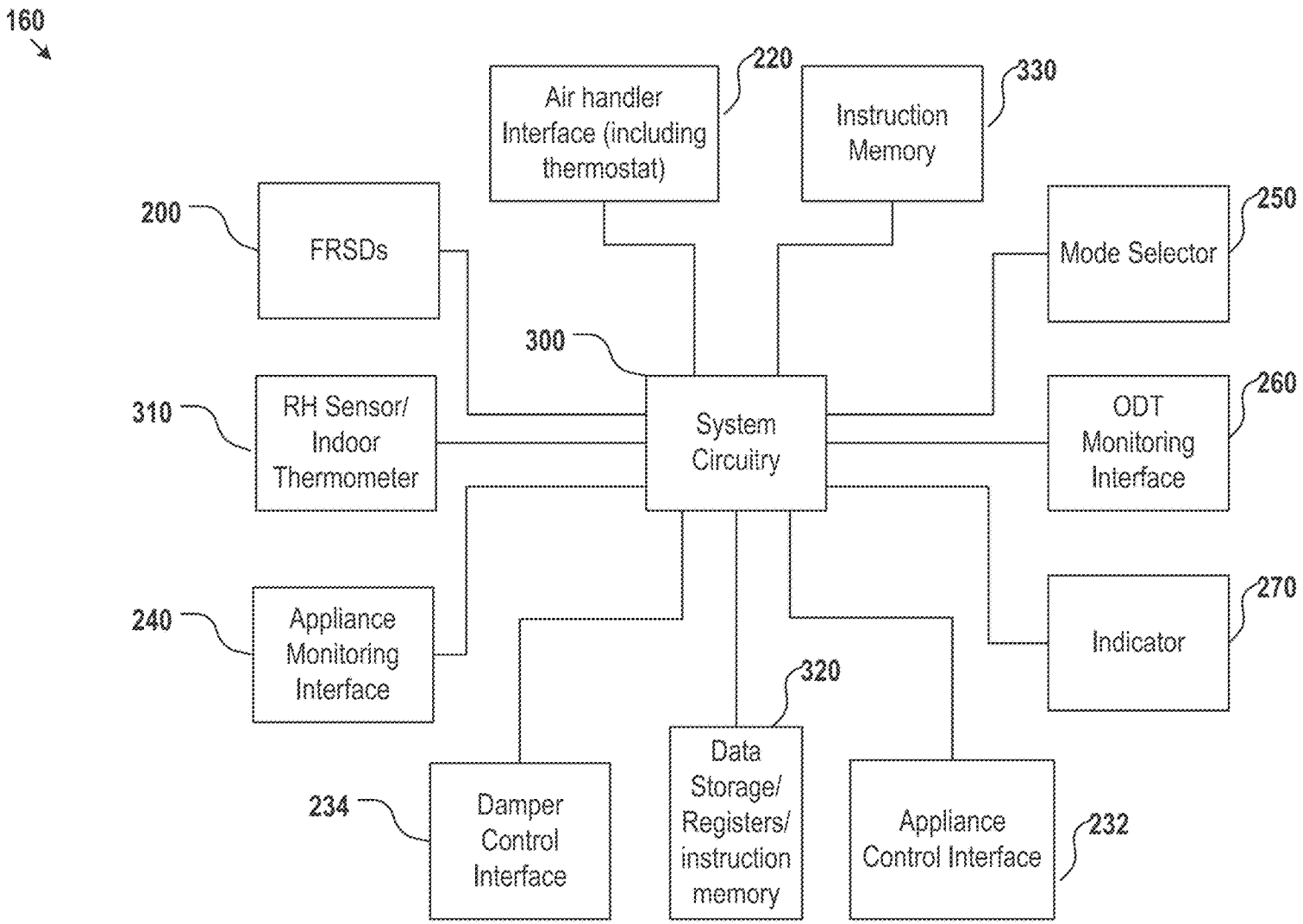
FIG. 3 shows an exemplary block diagram of various components of the exemplary FAV controller of FIG. 2.

FIG. 3 further illustrates an exemplary block diagram of the FAV controller 160. In particular, the FRSDs 200, the central air handler interface 220, the damper control interface 234, the appliance control interface 232, the appliance monitoring interface 240, the mode selector 250, the ODT monitoring interface 260, and the climate condition indictor 270 are coupled and provisioned by the system circuitry 300. The system circuitry 300 may further be electrically coupled to a relative humidity (RH) sensor and indoor thermometer 310 mounted on the FAV controller, a data storage/registers 320 for storing setting parameters and other parameters such as credit timer values discussed below, and an instruction memory 330 for storing instructions or firmware of the FAV controller. The memory may be of any suitable type. For example, the memory may be a non-transitory read-only memory. The system circuitry 300 may include a processor and other digital or analogue circuitry. The processor, for example, may be a microcontroller, a central processing unit, a field programmable gate array, or any other type of processor capable of executing instructions and performing the functions of the FAV controller 160.

Figure 4:
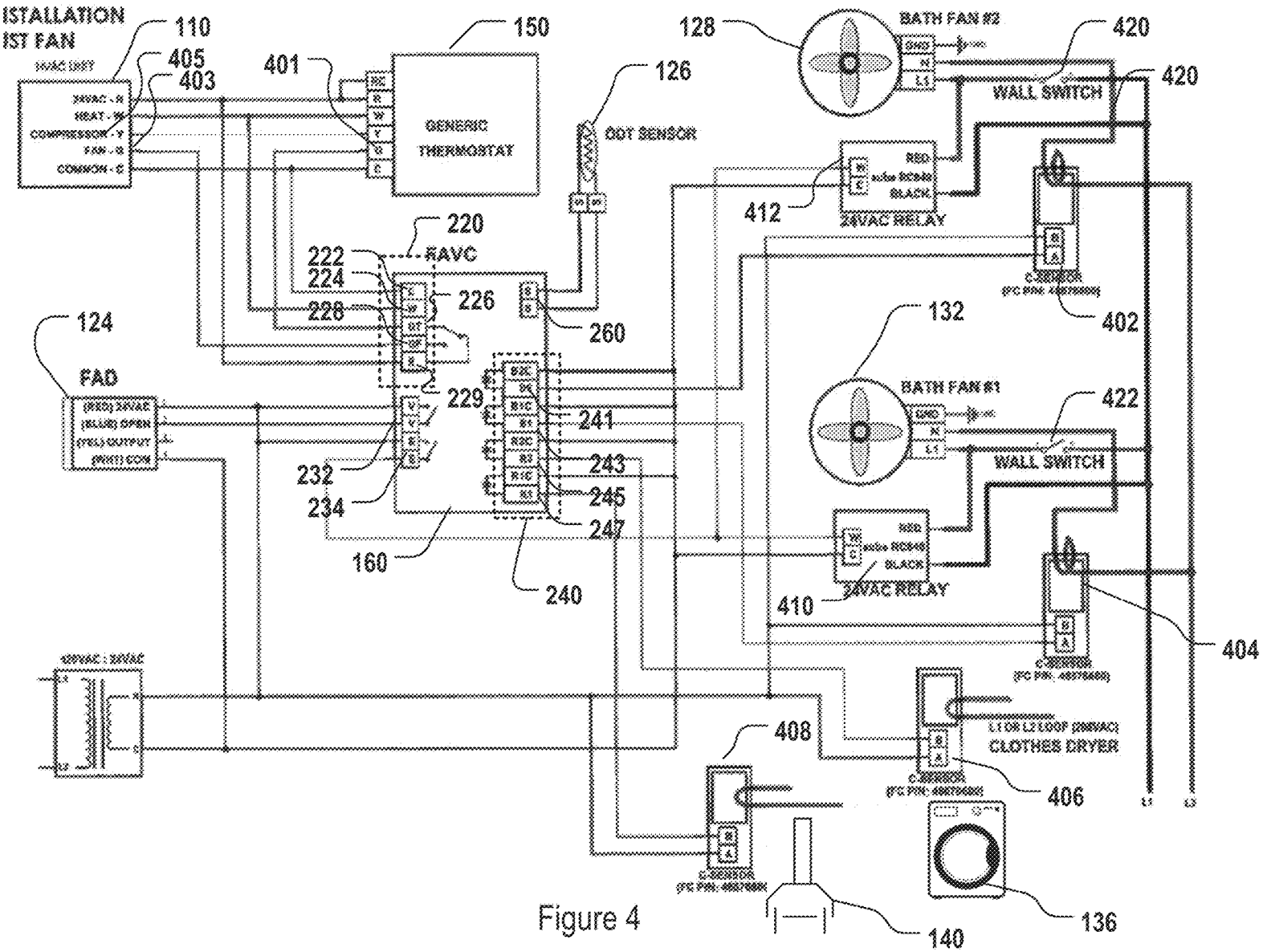
FIG. 4 illustrates an exemplary electric configuration of the FAV controller of FIGS. 2 and 3 in the air handling and ventilation system of FIG. 1.

FIG. 4 shows an exemplary connectivity between the FAV controller and various appliances, devices, and sensors with reference to the residential setting of FIG. 1. Specifically, the terminals of the central air handler interface 220 are connected to corresponding terminals of the thermostat 150 and the central air handler 110. The central fan control terminal 401 of the thermostat 150 is connected to the GT terminal 226 of the FAV controller 160 rather than directly to the fan control terminal 403 of the central air handler. This allows the FAV controller either to relay the fan control signal from the thermostat to the central air handler or take control of the central fan of the central air handler for ventilation or circulation if needed. The heat signal terminals W of the thermostat 150, the FAV controller 160, and the central air handler 110 are connected. As such, heating is directly controlled by the thermostat and the FAV controller may monitor heat calls. The cooling control terminal Y of the thermostat 150 is connected to the central air handler for control cooling but need not be connected to the FAV controller. The FAV controller may monitor cooling calls by analyzing the fan control signal GT and the heating control signal. Further, the damper control terminals 234 of the FAV controller is connected to the motorized damper 124. The ODT monitoring interface 260 is connected to the ODT sensor 126.

FIG. 4 illustrates four exhaust appliances that are monitored and/or controlled by the FAV controller 160, including the exhaust fans 128, 132, the clothes dryer 136 and the kitchen range hood 140 of FIG. 1. The operation of these exhaust appliances may be monitored by the sensors 402, 404, 406, and 408 disposed in the electric supply or return paths of these appliances. The operations of these devices may be at random times and for random durations. For example, an occupant of the residence may turn on the wall switches 420 and 422 of the exhaust fans 128 and 132 at any time and for any length of time. Sensors 402, 404, 406, and 408 are correspondingly connected to the appliance monitoring interface 240 of the FAV controller. Sensors 402, 404, 406, and 408 may be of any suitable type, e.g., current sensors disposed in the electrical paths of the exhaust appliances, such as Hall Effect sensors, current clamp meters, fluxgate transformer type of sensors, fiber optical current sensors, Rogowski coil sensors, and the like, and/or pressure/airflow sensors disposed in the air paths of the exhaust appliances. The exhaust fans 128 and 132 may further be controlled by the appliance control interface 232 (the E terminals) of the FAV controller via relays 412 and 410. In the example of FIG. 4, both exhaust fans 128 and 132 are controllable by the FAV controller. In other alternative implementations, only one of the exhaust fans may be controlled and the E terminals of the FAV controller may accordingly be only connected to control one of the two relays 410 and 412.

Figure 5:
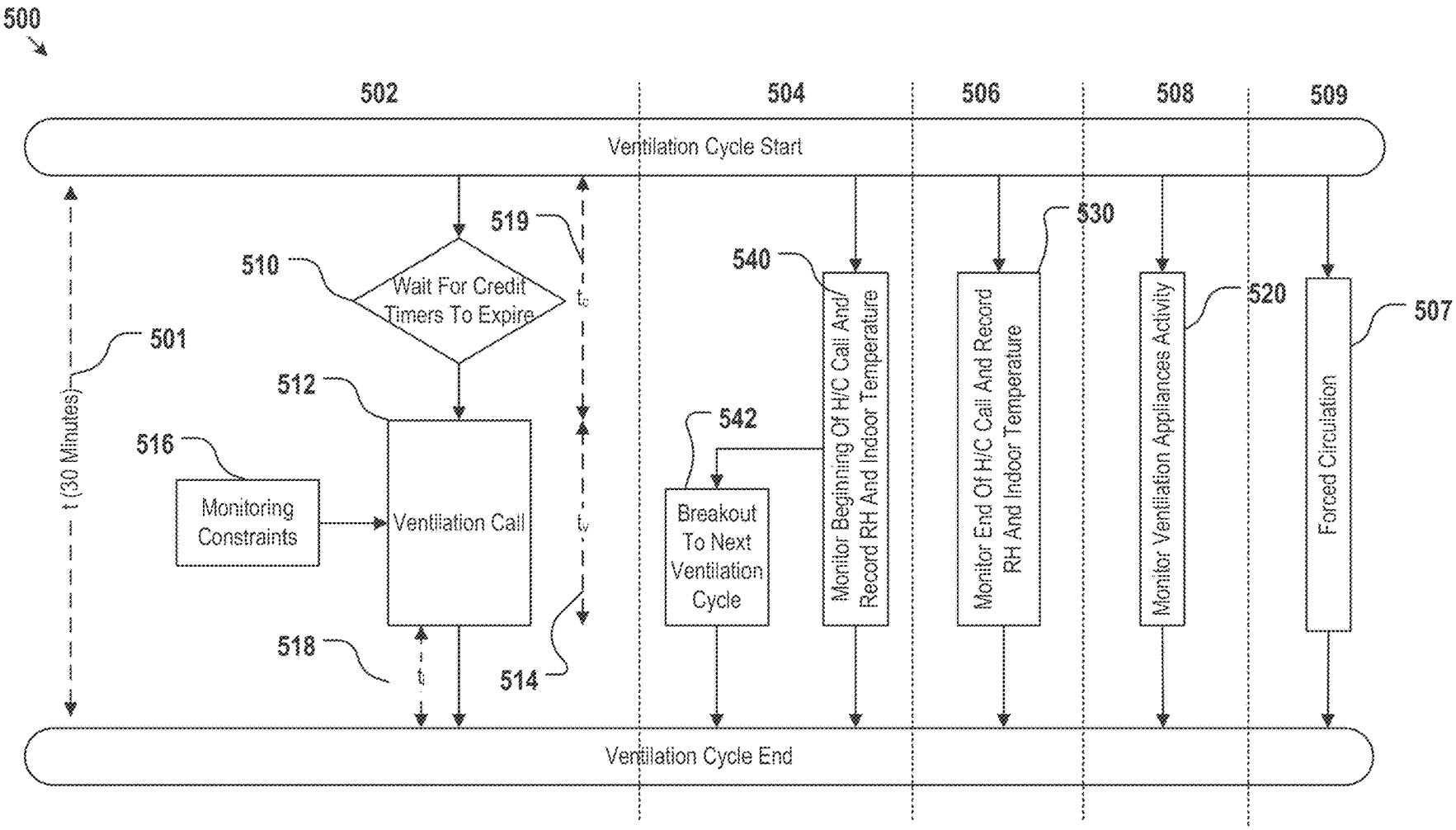
FIG. 5 shows an exemplary system logic flow of a FAV control cycle.

The FAV controller of FIGS. 1-4 may be configured to execute a firmware stored in the instruction memory 330 of FIG. 3 to perform various ventilation monitoring and controlling functions. Ventilation control may be performed in ventilation cycles. In each cycle, the FAV controller monitors and controls various appliances and devices to satisfy the ventilation target while maintaining air quality, monitoring the humidity and temperature constraints for protecting the furnace plenum from condensation. An exemplary logic flow in one ventilation cycle is illustrated in FIG. 5. The ventilation cycles may run on a predefined periodicity t. The cycle periodicity t, for example may be 30 minutes, as shown by 501 of FIG. 5, or may be set at any other suitable time period.

As illustrated by the exemplary implementation 500 of FIG. 5, the FAV controller 160 may perform one or more of several parallel processes 502, 504, 506, 508, and 509 during each ventilation cycle 501. In process 508, the FAV controller monitors operation of the exhaust appliances coupled to the appliance monitoring interface 240 of FIGS. 2-4 via sensors 402, 404, 406, and 408 of FIG. 4 (520). The various exhaust appliances may be monitored independently and their operation times within the ventilation cycle may be separately tracked. These exhaust appliances may be activated manually by an occupant of the residence at any random times and for any durations. In one implementation, the effective fresh air ventilation as a result of the operation of these exhaust appliances may not be taken into account during the current ventilation cycle but may be credited towards the next one or more cycles. The operation time of each appliance in the current ventilation cycle may be normalized towards the continuous ventilation flow requirement or target of the ASHRAE Standard 62.2 as specified by the FRSD 202 of FIG. 2.

Specifically, if the monitored operation time for an exhaust appliance coupled to terminals A1/AC1 (terminals 241 and 242 of FIGS. 2 and 3) is $t_{A1\text{-}actual}$, and the operational flow rate of this exhaust appliance as specified by FRSD 210 of FIG. 2 is $F_{A1}$, then the normalized operation time for the this exhaust appliance during the current cycle may be determined as:

$$t_{A1\text{-}Normalized}=t_{A1\text{-}actual}*F_{A1}/F_{target} \quad (2)$$

where $F_{target}$ is the target continuous flow rate as specified by the ASHRAE Standard 62.2 via Equation (1) and set in the FAV controller 160 by the FRSD 202 of FIG. 2. As such, the operation time of the exhaust appliance in the current ventilation cycle is normalized to an equivalent time of ventilation at the continuous target ventilation flow rate. Independent monitoring and normalization of operation times of other appliances via A2/AC2, A3/AC3, and A4/AC4 terminals (terminals 243-247 of FIGS. 2 and 4) are similar. As such, normalized operation times $t_{A1\text{-}Normalized}$, $t_{A2\text{-}Normalized}$, $t_{A3\text{-}Normalized}$, and $t_{A4\text{-}Normalized}$ may be independently tracked and used to credit towards ventilation target for the next one or more ventilation cycles (the credit may be sufficient to credit more than one cycle because the normalized operation times may be more than t of, e.g., 30 minutes). Each of these normalized operation times may be used to set a credit timer for the next one or more ventilation cycles. As such, four independent credit timers may be established according to this specific implementation.

In one implementation, the normalized operational times $t_{A1\text{-}Normalized}$, $t_{A2\text{-}Normalized}$, $t_{A3\text{-}Normalized}$, and $t_{A4\text{-}Normalized}$ (or the credit timer values) may be capped. For example, appliances with relatively small ventilation flow rates, such as those exhaust fans monitored by the A1/AC1 and A2/AC2 terminals of the FAV controller, may be limited to 30 minutes, or one ventilation cycle worth of credit. Appliances with medium ventilation flow rates such as a clothes dryer monitored by the A3/AC3 terminals of the FAV controller may be capped at 60 minutes, or two ventilation cycles worth of credit. Appliances with high flow rates such as those monitored by the A4/AC4 terminals of the FAV controller, on the other hand, may be limited to 240 minutes, or eight cycles worth of credit.

In some other implementation, the normalized operation times $t_{A1\text{-}Normalized}$, $t_{A2\text{-}Normalized}$, $t_{A3\text{-}Normalized}$, and $t_{A4\text{-}Normalized}$ (or the credit timer values) may further be weighted downwards considering that some appliances may not obtain the full specified ventilation flow rates, when, for example, the motorized damper is closed when the appliances are in operation, and draft of fresh air into the residence may not be sufficient for the appliances to exhaust at the specified flow rates. The weighting factor may be predetermined for each appliance. The operation state of the damper may be further monitored (via the V terminals of the FAV controller of FIGS. 2 and 4) and the normalized operational time of the appliances may only be weighed downwards for the portion of time when the damper is not open.

In one implementation, the appliance monitoring process 508 may be used to enable other functions and controls by the FAV controller 160. For example, a high flow rate appliance requiring makeup air may be monitored by the A4/AC4 terminals of the FAV controller. The FAV controller may be configured to force the motorized damper to open via the V terminals of the FAV controller and force the central fan to operate when it detects that the high flow rate appliance is in operation, irrespective of whether a fresh air ventilation call is needed during the ventilation cycle, whether heating/cooling is active, or whether there are any humidity and temperature constraints. For another example, some high flow rate appliance, such as a clothes dryer, may cause local ventilation that is unbalanced at the level of the entire residence. This type of appliances may be monitored by the A3/AC3 terminals of the AV controller. By setting a central fan circulation control mode specified by the dipswitch at positon 3 of the mode selector 250 of FIG. 2 to ON (see description above), the FAV controller may be configured to bypass the thermostat and turn on the central fan when it detects an operation of the appliance at terminal A3/AC3, irrespective of whether heating or cooling by the thermostat or ventilation call by the FAV controller is active. Activating the central fan in such a situation helps balance the local ventilation to the entire residence.

Continuing with the logic flow of FIG. 5, the FAV controller 160 may further perform the parallel processes 506 and 504 for monitoring beginning and ending of any of heating or cooling call by the thermostat during the current ventilation cycle (530 and 540). Such monitoring functions can be achieved via the W and GT terminals of the FAV controller (terminals 224 and 226 of FIGS. 2 and 4). In response to detecting a beginning or ending of a cooling or heating call, the FAV controller records the indoor temperature and relative humidity (RH) at the return path of the central air handler using the built-in thermometer and humidity sensor 312 of FIG. 3. As such, the FAV controller is preferably mounted on the return path of the central air handler with the indoor thermometer and humidity sensor 312 exposed to the air returning to the central air handler. In one implementation, only the most recent pairs of heating/cooling call start and end indoor temperature and RH are tracked. The most recent pair of beginning and ending heating/cooling call RH and temperature may be used for predicting the next heating/cooling call.

Optionally in one implementation, when a beginning of a heating or cooling call is detected in process 504 of FIG. 5, the FAV controller may immediately end the current ventilation cycle and start the next ventilation cycle, irrespective of whether the current cycle time t of, e.g., 30 minutes, has expired, as shown by the logic flow step of 542 of FIG. 5.

Continuing with FIG. 5, the FAV controller may implement ventilation control functions during the current ventilation cycle in process 502. Specifically, at 510, the FAV controller may first wait for all the independent credit timers set from previous cycles to expire before proceeding. If any of the credit timers is more than t (501), the current ventilation cycle may continue to the end without ventilation intervention in process 502 by the FAV controller.

In process 502, once all the credit timers lapse during the current ventilation cycle (after $t_c$, 519), the FAV controller may perform ventilation call 512 for a duration $t_v$ (514) such that the ventilation target for the current cycle is satisfied. During the ventilation call, various constraints and conditions may be monitored (516) by the FAV controller and the ventilation call may be terminated or the ventilation duration may be reduced when the constraints and conditions prohibit a full ventilation for, e.g., the protection of the furnace plenum from condensation. Once the ventilation target is satisfied, the ventilation call ends and the ventilation cycle continues for an idle period $t_i$ (518) until the current ventilation cycle ends and the FAV controller enters the next ventilation cycle.

The process 509 of FIG. 5 may be used by the FAV controller to force the central fan to circulation air in the residence. Circulation of air may be forced when the FAV controller is set to energy saving mode, and the central fan has been idle for a predetermined extended period of time, e.g., 4 hours, either because the thermoset is turned off or heating/cooling is not triggered. The forced circulation may be configured to last for, e.g., one ventilation cycle.

Figure 6:
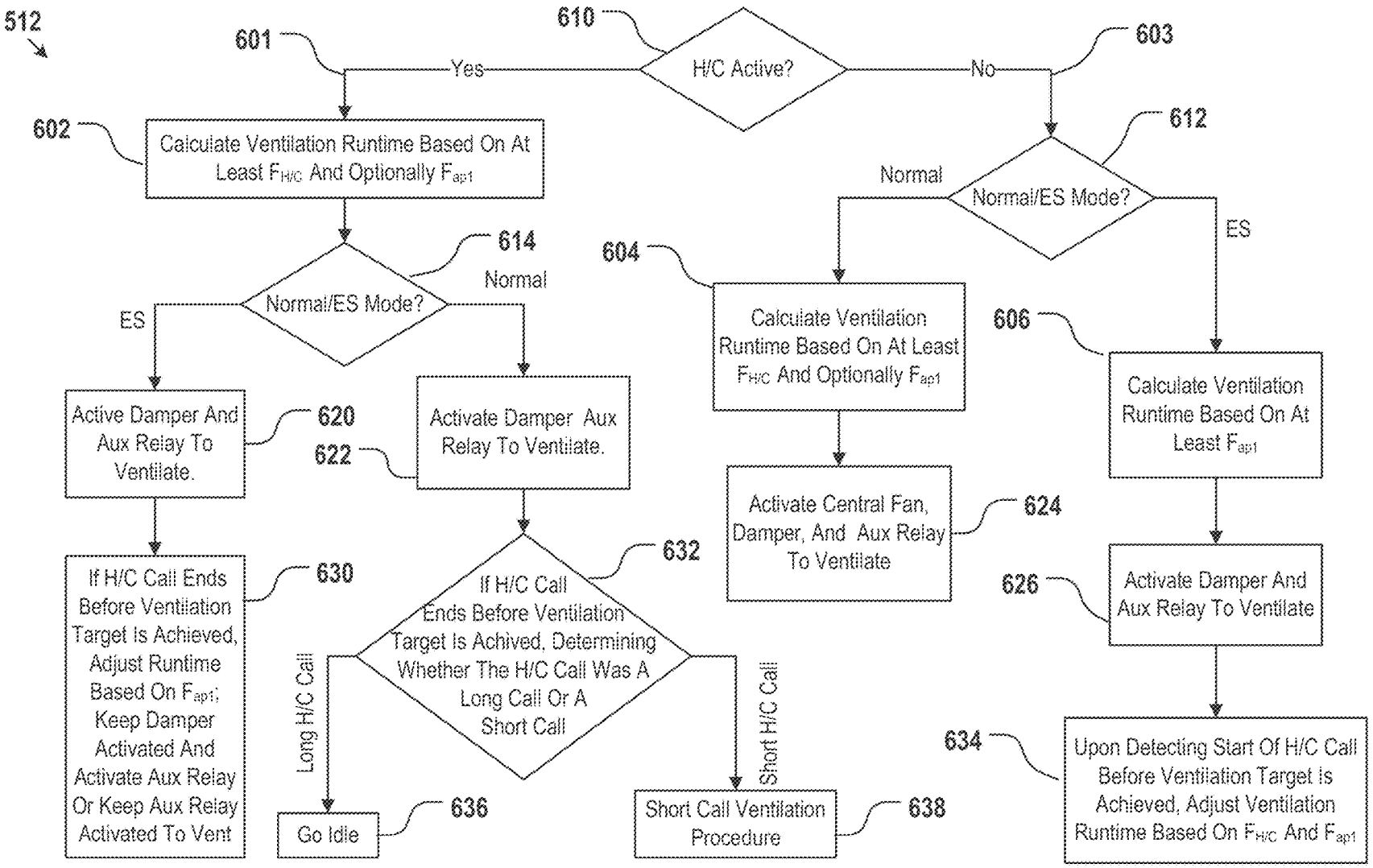
FIG. 6 shows an exemplary implementation of the ventilation call block of the logic flow of FIG. 5.

FIG. 6 illustrates an exemplary logic flow for the ventilation call 512 in more detail. The FAV controller first determines a length of the ventilation call (602, 604, and 606). To determine the length of the ventilation call, the credit time $t_c$ of FIG. 5 is first taken off a normalized ventilation target time $t_{target}$, e.g., 30 minutes. The length of the ventilation call is determined by:

$$t_v=(t_{target}-t_c)*F_{target}/F_{exp} \quad (3)$$

where $F_{exp}$ is an expected ventilation flow rate during the ventilation call. The expected ventilation flow rate depends on which and how many ventilation appliances are expected to be in operation for the ventilation call.

Thus, as shown in FIG. 6, in one implementation, the FAV controller may calculate the length of the ventilation call differently depending on whether the heating or cooling by the central air handler is active at the time the ventilation call begins (610). When heating/cooling is active (branch 601), as monitored via the W and GT terminals of the FAV controller in FIGS. 2 and 4, the FAV controllers calculate the runtime of the ventilation call assuming that the central van will continue to be on under the control of the thermostat, giving rise to a ventilation flow rate as set in FRSD 204 or 206 of FIG. 2. The calculation of the runtime of the ventilation call (602) in branch 601 thus may be irrespective of whether the FAV controller is set in the normal mode or the energy saving mode via the position 4 of the mode selector 250 of FIG. 2 and Table 1 (e.g., step 614 is after step 602 in FIG. 6). The FAV controller will activate the E terminals (232 of FIGS. 2 and 4) to turn on any controlled exhaust appliances. The flow rate of these appliances (set in the FRSD 210 of FIG. 2) may either be added to the ventilation flow rate of the central fan when calculating the runtime of ventilation call in the current cycle, or be disregarded but credited as monitored in process 502 of FIG. 5 to the next one or more ventilation cycles. Thus, the runtime of the ventilation call calculated in 602 may be based on Equation (3) using, as an effective flow rate $F_{exp}$, the flow rate of the central fan in either heating or cooling mode and optionally compounding the flow rate of the exhaust appliance to be activated by the E terminal of the FAV controller.

However, if the FAV controller detects that heating/cooling is not active (branch 603 of FIG. 6), the runtime of the ventilation call may then depend on whether the FAV controller is set in the normal mode or the energy saving mode, as shown by 612, 604, and 606 of FIG. 6. In the normal mode, because the FAV controller will turn on the central fan via the GF terminals of FIGS. 2 and 4 as well as any exhaust appliance connected to the E terminals of the FAV controller, the expected flow rate $F_{exp}$ of Equation (3) for calculating the runtime of the ventilation call may be the ventilation flow rate of the central fan and optionally the sum of the ventilation flow rate of the central fan and the controlled exhaust appliances (604, similar to 602). In the energy saving mode, because only the controlled exhaust appliance will be in operation in the absence of heating or cooling, the expected flow rate $F_{exp}$ of Equation (3) for calculating the runtime of the ventilation call may only include the flow rate of the controlled exhaust appliance as set by the FRSD 210 of FIG. 2 (606).

Continuing with FIG. 6, once the runtime of the ventilation call is determined in 602, 604, and 606, the FAV controller activates its V terminals to open the motorized damper of FIGS. 1 and 4 and further activates the exhaust appliances controlled by terminal E of FIGS. 2 and 4 (see steps 620, 622, 624, and 626 of FIG. 6). In 620, under energy saving mode and when heating or cooling is active, the central fan may still be in operation as controlled by the thermostat even if the FAV is operating in the energy saving mode. In 622 (normal mode with heating/cooling active), the FAV controller needs not to control the central fan because the central fan is already on as controlled by the thermostat. In 624 (normal mode with heating/cooling inactive), the FAV controller further turns on the central fan via the GF terminal of FIGS. 2 and 4. In 626 (energy saving mode with heating/cooking inactive), the central fan is not turned on by the FAV controller and remains inactive.

Continuing with FIG. 6, following step 620, and in step 630, if the FAV controller detects an end of the heating or cooling call in the energy saving mode before the runtime of ventilation call has lapsed, the FAV controller will not keep the central fan on and may adjust the runtime of the ventilation call considering that the central fan is now off and the ventilation flow rate has dropped. Upon the adjustment of the runtime of the ventilation cycle, the FAV controller keeps the motorized damper open and keeps the E terminal active until the end of the adjusted runtime of the ventilation call or the end of the current ventilation cycle.

Following step 622 of FIG. 6, and in 632, if the FAV controller detects an end of the heating or cooling call in the normal mode before the runtime of ventilation call has lapsed, it may further determine whether the ended heating or cooling call was a long call or short call, where a long call may be a call that is longer than a predetermined threshold of, e.g., 5 minutes, and a short call may be a call that is equal to or shorter than the predetermined threshold. In one implementation, if the heating or cooling call was a long call, the FAV controller may terminate the ventilation call and go into idle (636). If the heating or cooling call was a short call, then the FAV controller may continue with the ventilation if the remaining ventilation time is equal to or less than a predetermined amount (e.g., 5 minutes) and may terminate the ventilation and go into idle if the remaining ventilation time is longer than the predetermined amount (short call procedure in normal mode 638).

Following step 626 of FIG. 6, and in 634, if the FAV controller detects a beginning of a heating/cooling call in the energy saving mode before the runtime of ventilation call has lapsed, the FAV controller may adjust the runtime of the ventilation call considering that the central fan is now turned on by the thermostat and the ventilation flow rate has increased. Upon the adjustment of the runtime of the ventilation cycle, the FAV controller keeps the motorized damper open and keeps the E terminal active until the end of the adjusted runtime of the ventilation call or the end of the current ventilation cycle.

Figure 7:
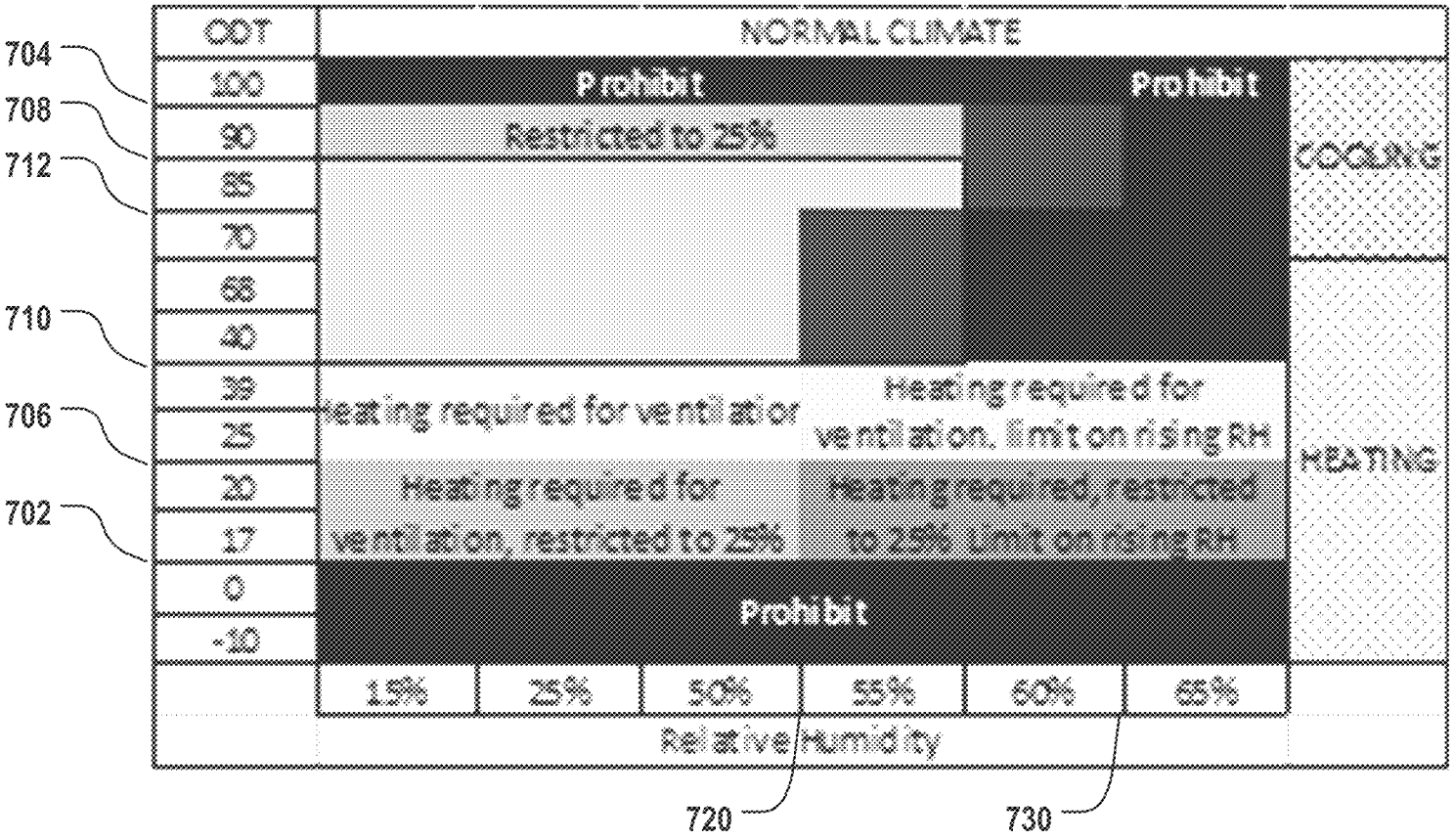
FIG. 7 illustrates various constraints and conditions that may be applied by the FAV controller in a space defined by outdoor temperature and relative humidity of return air.

The ventilation call 512 of FIG. 5 may be aborted or reduced in runtime at any time when one or more of a predefined set of constraints are detected in 516. These constrains may be designed for maintaining the air quality (e.g., humidity level) and for protecting the furnace plenum from condensation. These constraints, for example, may be based on the ODT and RH of return air into the central air handler. FIG. 7 illustrates examples of these constrains represented in a space of ODT (vertical axis) and RH (horizontal axis).

As shown in FIG. 7, a high temperature threshold 704 and a low temperature threshold 702, e.g., $T_{high}$=100° F. and $T_{low}$=17° F., may be set for the ODT. Accordingly, the FAV controller may be programed to terminate any ventilation call by, e.g., closing the motorized damper and turning off controlled ventilation appliances when the ODT sensor 126 of FIGS. 1 and 4 detects these temperature extremes in the ventilation air in the FAV duct 120 of FIG. 1 before entering the return path 111 of the central air handler.

For another example in FIG. 7, the FAV controller may be configured to require heating to be active when the ODT is less than a heating temperature threshold $T_{heat}$ 710, e.g., $T_{heat}$=40° F. As such, the FAV controller may be configured to monitor the ODT via the ODT sensor and terminate any ventilation call if the ODT is less than $T_{heat}$ and the heating is not active. For yet another example, the FAV controller may be configured to reduce ventilation when it detects that the ODT is below a low ventilation reduction threshold $T_{low\text{-}reduction}$ 706, e.g., $T_{low\text{-}reduction}$=25° F. The ventilation requirement and thus the corresponding ventilation call runtime may be adjusted to a predetermined percentage, e.g., 25%, of the target. The FAV controller may be configured to similarly reduce ventilation when it detects that the ODT is above a high ventilation reduction threshold $T_{high}$-reduction 708, e.g., $T_{high\text{-}reduction}$=90° F.

For another example, the FAV controller may be further configured to prohibit ventilation when it determines that the mixed ventilation air and return air at the central air handler is below a low mixed air temperature threshold Tow-mixed, e.g., $T_{low\text{-}mixed}$=55° F. The FAV controller may determine the mixed air temperature using the ODT sensor reading and its built in indoor thermometer 310 of FIG. 3 based on, for example, psychrometric calculations.

Further, as shown in FIG. 7, the FAV controller may be configured such that when the ODT is below $T_{heat}$ (710 of FIG. 7, e.g., 40° F.) and if the RH measured by the FAV controller using the humidity sensor 310 of FIG. 3 is above a first RH threshold $H_1$ 720, e.g., $H_1$=55% and is not dropping during a ventilation cycle, the ventilation may be reduced (or canceled if ODT is below Tow 702). Further, the FAV controller may be configured to permit ventilation when the ODT is between $T_{heat}$ 710 and $T_{RH}$ 712 (e.g., $T_{RH}$=85° F.) as long as the RH is below threshold $H_1$ 720. If the ODT is between $T_{RH}$ 712 and $T_{high\text{-}reduction}$ 708, the FAV controller may permit ventilation if the RH does not exceed a second RH threshold $H_2$ 730, e.g., $H_2$=65%.

The various thresholds temperatures and threshold RHs in FIG. 7 and the description above are only intended as examples. These settings may be configurable according to the climate mode as set by positions 3 and 4 of the mode selector 250 of FIG. 2 and Table 1. FIG. 7, for example, may be intended for a set of thresholds for the normal climate mode. These thresholds may be different for the cold climate and hot climate modes. For example, Tow may be set at 0° F. rather than 17° F. and $T_{heat}$ may be set at 50° F. rather than 40° F. for the cold climate mode. Further, the LED climate indictor 270 of FIG. 2 may be configured at various predetermined color for indicating which region in the ODT-RH space the FAV controller is operating in.

In the implementations described above with respect to FIGS. 2 and 4-7, the cooling signal (Y) from the thermostat (shown as 405 in FIG. 4) is not connected to the FAV controller 160 and is not utilized in determining ventilation calls. determination of cooling calls are based on composite signal from the heating signal 224, central fan signal 226 of FIG. 2, as described above with respect to FIG. 2. In some other alternative implementations as described below, such cooling signal (used to active compressor 118 of FIG. 1) may be connected to the FAV controller 160 and utilized for controlling the ventilation. In these implementations, the FAV control terminals of FAV controller may correspondingly include in the central air handler interface 220 of the FAV controller 160 (see, e.g., FIG. 2) a cooling terminal 223 (also denoted by "Y") along with the C (222), W (224), GT (226), and GF (228) terminals. In a system using heat pumps, the compressor signal indicates either cooling or heating, depending on the ambient temperature. Further for heat pumps, Y (223 of FIG. 2) or W (224 of FIG. 4) may be active for heating. Conventional systems may use Y for cooling and W for heating purposes. Monitoring the Y terminal helps to identify when the thermostat is calling for cooling or heating (heat pump) so the continuous fan operation can be ignored. These implementations allow for a means to differentiate a condition where the thermostat is set to continuous fan but may be turned off for providing temperature control, or the homeowner has a preference for air flow distribution though the home at all times. Compared to the implementations described above in FIGS. 2 and 4-7, in these alternative implementations, the determination of start and end of cooling calls in process 504 and 506 would be based on the compressor or cooling signal Y (monitored by terminal 223 of FIG. 2 from the thermostat terminal 405 of FIG. 4).

Compressor monitoring further allows for improved conditional and/or constrained ventilation (process 516 of FIG. 5 as described above, such as ventilation permitted only when the system is heating or cooling as described above with respect to FIG. 7) during the ventilation call 512 of FIG. 5. For example, as shown in the example of FIG. 7, conditional ventilation for cooling as indicated by the "Y" signal is set to be in effect at 85° F. or higher (indicated as temperature above 712 in FIG. 7). In some exemplary implementations, for relative humidity (RH) conditions above a limit of 50%, compressor-on may be required for ventilation to take place. Conditions above a RH of 55% may will restrict ventilation (to, e.g., 25%) until the RH value drops below 50%. This function would allow ventilation only when the system is working to remove humidity (compressor is active). The 25% reduction in ventilation based on elevated temperatures is also linked to the compressor signal. The same conditions can be said about the heating conditions. However the operation for ventilation is a bit different. When outside temperatures are below 40° F. (heating is required for ventilation in all three climate categories). This is also the temperature setpoint for dehumidification function. The original software had this set point at 32° F. Depending on climate zone chosen, this function would not be very effective. The change in set point to activation the dehumidification setting will improve the effective potential of this function. The algorithm was also improved in the tracking of humidity control when the dehumidification is enabled. Dehumidification will not be active until the RH value rises above 55%. At any given point in time that ventilation is active, a rise in RH after the ventilation cycle has started will terminate the ventilation function and hold off any further activity that may be result of the rise in humidity.

Examples of conditional/restrained ventilation based on temperature for these implementations utilizing the compressor signal are described below. When the ODT sensor (126 of FIG. 1) detects temperature higher than 85° F., the FAV controller may require compressor activity as monitored by the Y signal for the ventilation call to be active. When the ODT sensor detects temperature higher than 90° F., the FAV controller may require compressor activity as monitored by the Y signal for the ventilation call to be active and at the same time reduce the ventilation to a limited level (e.g., 25%). When the ODT sensor detects temperature higher than 100° F., the FAV controller may prohibit the ventilation regardless of the compressor signal. When the ODT sensor detects temperature lower than 40° F., the FAV controller may require either compressor activity as monitored by the Y signal or heating activity (as monitored via the W signal for the ventilation call to be active. This configuration covers both a conventional cooling/heating system and a heat pump system (where both heating signal and cooling signal would be provided by compressor signal). When the ODT sensor detects temperature lower than a predetermined ventilation restricting temperature (e.g., 25° F.), the FAV controller may require either compressor activity or heating activity for ventilation to be active and at the same time reduce the ventilation to a limited level (e.g., 25%). When the ODT sensor detects temperature lower than, e.g., 0° F., the FAV controller may prohibit ventilation. For ODT temperature not restricted/conditioned above, ventilation call may be remain activated without restriction and regardless of the compressor signal.

Examples of conditional/restrained ventilation based on relative humidity for these implementations utilizing the compressor signal for ODT temperature above 70° F. are further described below. When the indoor RH is below, e.g., 50%, the FAV controller may not further restrict ventilation beyond what was described above for temperature restriction. When the indoor RH is above 50% but below, e.g., 55%, the FAV may require compressor to be active for ventilation via the V terminal (234 of FIG. 2, for controlling the damper 124 of FIG. 1) but does not require the compressor to be active for ventilation via the E terminal (232 of FIG. 2 for controlling the energy efficient exhaust appliance). When the indoor RH is above 55% but below, e.g., 60%, The FAV controller may require compressor activity for ventilation via both V and E terminals and may further reduce ventilation to, e.g., 25%. When the indoor RH is above 60%, the FAV controller may prohibit ventilation. In one implementation, this prohibition may lock in the RH limit such that it cannot be released until indoor RH falls below 50% for the ventilation to be reactivated.

Examples of conditional/restrained ventilation based on relative humidity for these implementations utilizing the compressor signal for ODT temperature below 70° F. are further described below. When the indoor RH is below, e.g., 50%, the FAV controller may not further restrict ventilation. When the indoor RH is above 50% but below, e.g., 55%, a dehumidification function may be enabled but not active unless outdoor temperature is below 40° F. When the indoor RH is above 55%, a dehumidification function may be activated and ventilation may be permitted if heat (W) or compressor (Y) signals are present. The dehumidification process requires that indoor RH drops during a timed duration while ventilation is active. If humidity levels rise, while dehumidification process is active, ventilation will be disabled until indoor RH falls below 50%. When outdoor temperature rises above 40° F., the dehumidification mode may be disabled and ventilation may not be permitted.

Figure 8:
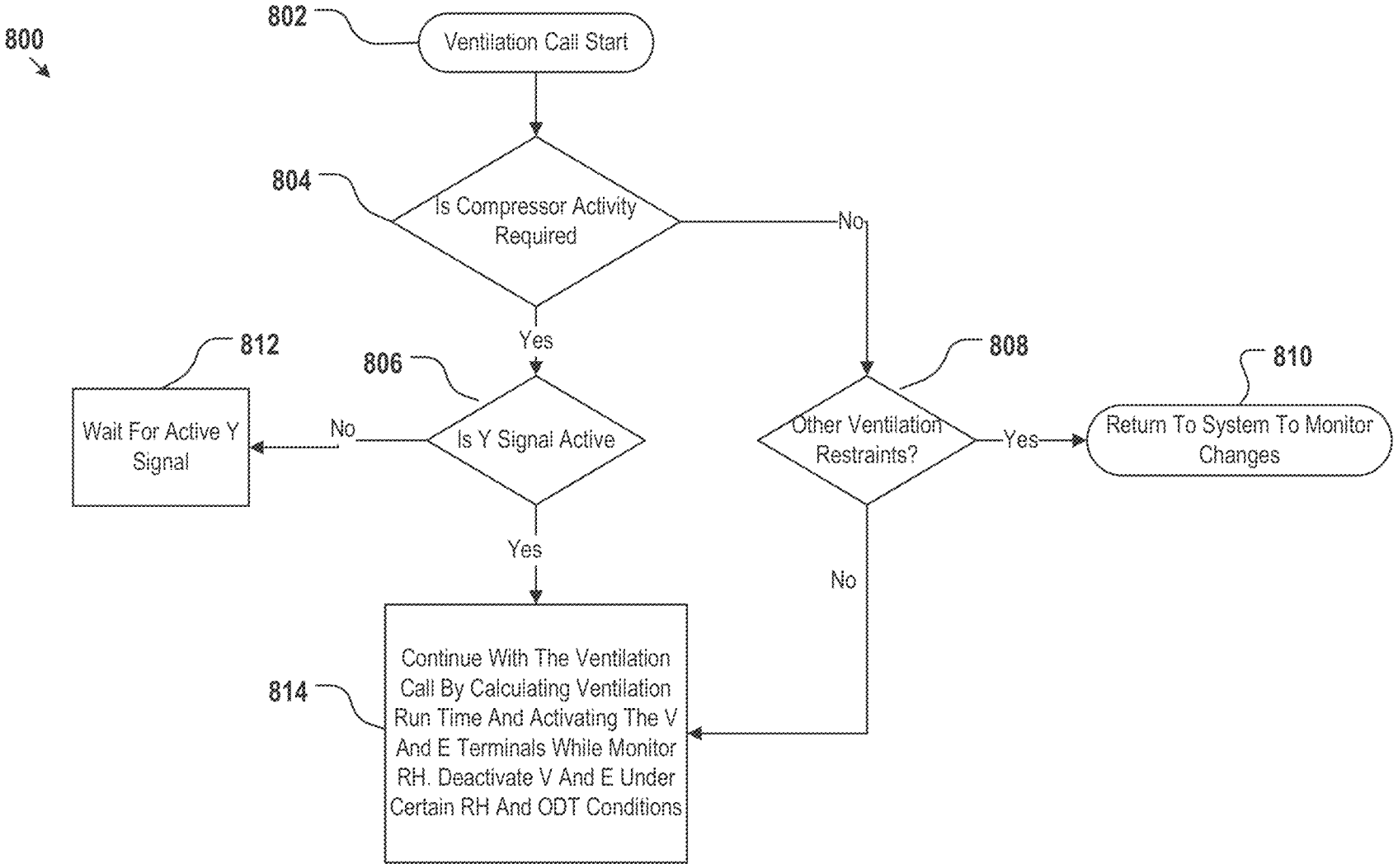
FIG. 8 illustrates a logic flow for ventilation call conditioned on monitoring a compressor signal in cooling mode.

An exemplary logic flow for ventilation call conditioned on compressor signal Y for ODT higher than 70° F. as described above is shown as 800 in FIG. 8. In particular, ventilation call of 512 in FIG. 5 starts at 802. The FAV controller first determine whether the compressor activity is required for the ventilation to be activated (with exemplary scenarios requiring compressor activity discussed above) at 804. If the compressor activity is not required for ventilation, the FAV controller further checks other ventilation constraints (808). If there are other constraints that prevent ventilation from being activated, the FVA controller keep monitoring system changes (810). If FAV controller determines that the compressor activity is required in 804, it then further determine whether the compressor is active by monitoring Y signal (806). If the FAV controller determines that compressor is not active, it the continue to monitor compressor signal to indicate compressor activity (812). If the FAV controller determines that compressor activity is required (804) and the Y signal is active (808), or determines that the compressor activity is not required (804) and no other ventilation restraints are present (808), it proceed in 814 to activate the ventilation by calculating the ventilation run time during the current ventilation call and activate the V (ventilation damper) and E (energy efficient exhaust appliance) based on energy mode as set of the dipswitches 250 in FIG. 2. The FAV may further monitor in 814 the RH and deactivate the V and E terminals under certain RH condition, for example, if RH rise above, e.g., 60%.

Figure 9:
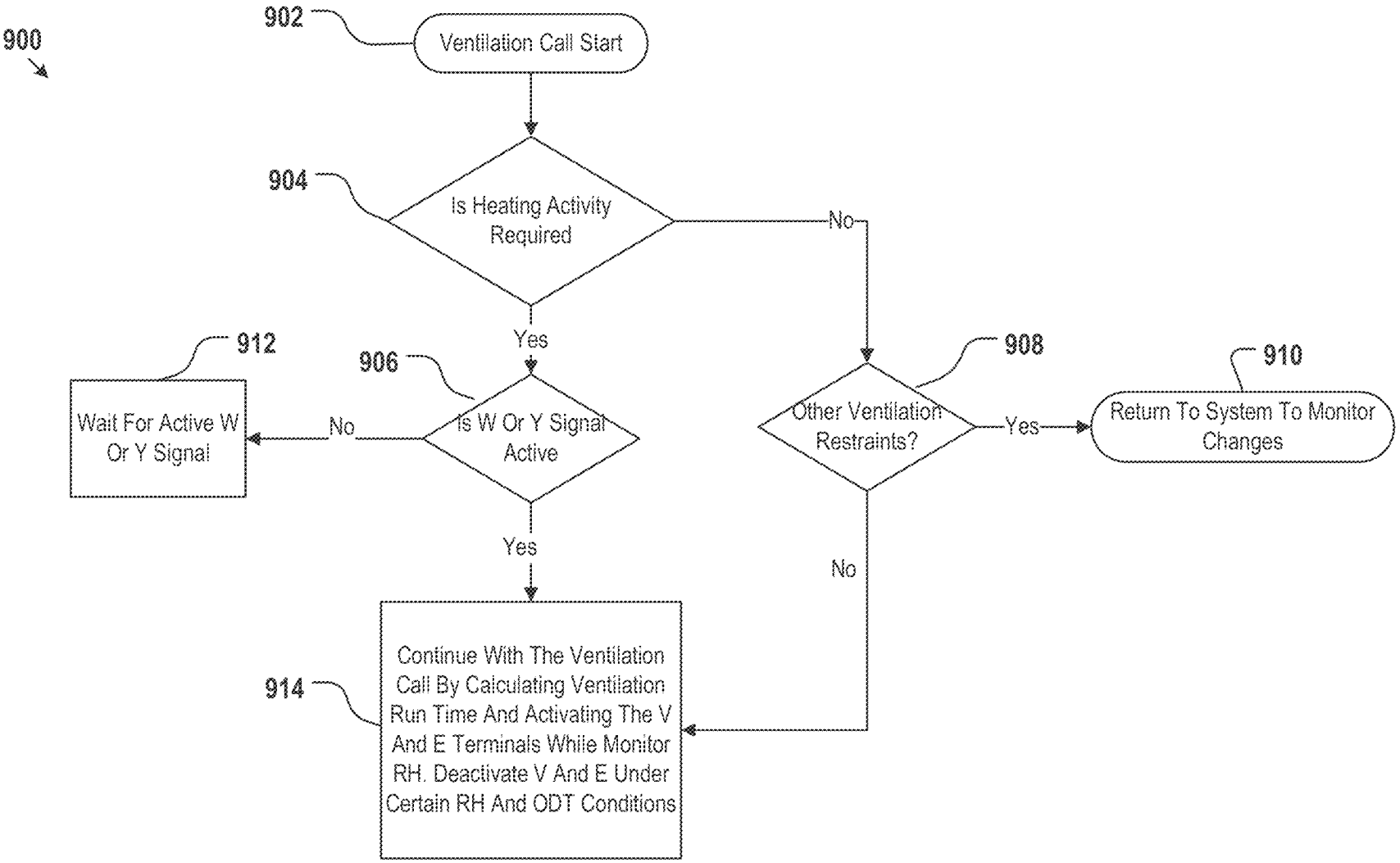
FIG. 9 illustrates a logic flow for ventilation call conditioned on monitoring a compressor signal or a heating signal in heating mode.

An exemplary logic flow for ventilation call conditioned on the compressor (Y) and heating (W) signal for ODT lower than 70° F. is shown in FIG. 9. The logic flow of FIG. 9 is similar to the logic flow shown in FIG. 8, except that in 904, whether heading rather than cooling is required during the ventilation call, and in 914, the RH and ODT conditions for deactivating the ventilation would be different from the RH conditions for deactivation of the ventilation in 814 of FIG. 8.

The FAV controller disclosed above is configured to independently monitor up to four exhaust appliances. The FAV controller may monitor a wide range of types of appliances, with their operational flow rate flexibly configured via the FRSDs. Each of the four pairs of monitoring terminals may be wired to monitor a group of appliances rather than a single appliance. As such, the FAV controller disclosed above may be capable of monitoring more than four individual appliances, as long as the sum of the flow rates within each appliance group does not exceed the maximum setting of the corresponding FRSD. The FAV controller further provides control over a single or a group of exhaust appliances and control over the central fan, bypassing the thermostat if needed for ventilation. The ventilation is controlled periodically to satisfy a target continuation FAV flow rate subject to constraints and conditions designed to protect the furnace plenum from condensation. The constraints and conditions are monitored by the FAV controller via various humidity and temperature sensors. The monitored operation of various exhaust appliances is credited to the ventilation target, providing energy savings and preventing over ventilation. The FAV controller further provides a dual mode ventilation control (normal mode and energy saving mode) and multiple climate modes.

In some other implementations, a progressive restraint on ventilation during ventilation calls may be used depending on the RH level. For example, the progressive ventilation may be implemented in a plurality of progressive levels (rather an a two-level implementation of either 25% or 100% discussed in the implementations above). In particular, when the FAV controller determines to proceed with a ventilation call during a ventilation cycle, it may calculate the ventilation run time and then reduce the run time according to the RH level as monitored by the FAV. For example, when the RH is below 50%, the ventilation run time may not be reduced. When the RH is between e.g., 50% and 52%, the ventilation run time during the current ventilation cycle may be reduced to 75%. When the RH is between e.g., 52% and 55%, the ventilation run time during the current ventilation cycle may be reduced to 50%. When the RH is between e.g., 55% and 60%, the ventilation run time during the current ventilation cycle may be reduced to 25%. When the RH is above e.g., 60%, the ventilation may be prohibited during the current ventilation cycle. The progressive ranges of RH and corresponding amount of ventilation reduction above are mere examples and are not limiting. Progressive ventilation with finer granularity or continuous progression may be similarly implemented. The progressive ventilation may be implemented in the cooling mode or both in the cooling mode and heating mode. Such progressive ventilation may be particularly relevant to the cooling mode because throttling the amount of ventilation progressively downward depending on RH levels would provide less damaging condensation at the furnace plenum during cooling where the furnace is not active.

In yet some other implementations and when a ventilation prohibition condition occurs (e.g., when RH is above 60%, or under any other prohibition condition discussed or not discussed above), the ventilation would be prohibited but the FAV controller may allow forced ventilation when the prohibition period persists longer than a preset threshold. For example, if the prohibition condition persists for more than, e.g., 4 hours, the FAV may allow one or more cycles of ventilation. For example, the FAV may reset a timer and begin countdown when a prohibition starts. If the prohibition condition persists and no ventilation is performed during the countdown, the FAV may allow ventilation after the timer counts down to zero. Such forced ventilation may be permitted for one or more ventilation cycles and if the prohibition condition persists, the FAV may restore prohibition, reset the timer, and begin a next countdown. Such ventilation under prohibition condition is aimed at providing at least some amount of ventilation during an otherwise long prohibition stretch. In some implementations, such ventilation may be provided at a reduced level, e.g., 25%. In order to reduce potential life-reducing damage to the heating/cooling system, in some implementations, such ventilation may only be allowed when cooling or heating is active as monitored by the FAV controller as discussed above.

In the detailed disclosure above, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

The illustrations of the implementations described herein are intended to provide a general understanding of the structure of the various embodiments. The illustrations are not intended to serve as a complete description of all of the elements and features of apparatus and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

The invention claimed is:

1. A fresh air ventilation control (FAVC) apparatus, comprising:

a first electric interface adapted to couple to a sensor for monitoring an operation of an exhaust appliance;

a second electric interface adapted to couple to an air handler and a thermostat for controlling the air handler;

a third electric interface adapted to couple to a thermometer for monitoring temperature of fresh air in a ventilation path coupled to a return path of the air handler;

a humidity sensor for monitoring relative humidity of a return air of the air handler; and a system circuitry configured to, based on the temperature of fresh air and the relative humidity of a return air being within threshold ranges, transmit a call to request supplemental fresh air, wherein the system circuitry is configured to, during runtime, reduce a ventilation call runtime to a predetermined percentage that facilitates supply of the supplemental fresh air when the relative humidity is above 50%.

2. The FAVC apparatus of claim 1, wherein:

the system circuitry is configured to transmit the call to request supplemental fresh air when the temperature is in a range between a threshold minimum temperature and a threshold maximum temperature.

3. The FAVC apparatus of claim 2, wherein the threshold minimum temperature is about 17° F.

4. The FAVC apparatus of claim 2, wherein the threshold maximum temperature is about 100° F.

5. The FAVC apparatus of claim 2, wherein:

the system circuitry is configured to transmit the call when heating is active and the temperature is above the threshold minimum and below a heating temperature threshold.

6. The FAVC apparatus of claim 5, wherein:

based on the heating being active and the temperature being above the threshold minimum and below a low ventilation temperature threshold, the system circuitry is configured to reduce the ventilation call runtime; and the low ventilation temperature threshold is below the heating temperature threshold.

7. The FAVC apparatus of claim 5, wherein the heating temperature threshold is about 40° F.

8. The FAVC apparatus of claim 1, wherein the system circuitry is configured to restrict ventilation or terminate ventilation when the relative humidity (a) is above 55% and (b) is not dropping or is rising.

9. The FAVC apparatus of claim 1, wherein the system circuitry is configured to transmit the call to request supplemental fresh air when (a) the temperature is in a range between a heating temperature threshold and a threshold maximum temperature and (b) the relative humidity is below a threshold humidity.

10. The FAVC apparatus of claim 1, wherein the ventilation call runtime is reduced to 25% when the relative humidity is above 55%.

11. The FAVC apparatus of claim 1, wherein the system circuitry is configured to restrict ventilation or terminate ventilation when the relative humidity is above 55% until the relative humidity drops below 50%.

12. The FAVC apparatus of claim 1, wherein a dehumidification is not active until the relative humidity rises above 55%.

13. The FAVC apparatus of claim 1, wherein the system circuitry is configured to permit ventilation when the relative humidity does not exceed 65%.

14. The FAVC apparatus of claim 1, wherein compressor activity is required for ventilation when the relative humidity is above 50%.

15. The FAVC apparatus of claim 1, wherein the system circuitry is configured to progressively restrain ventilation according to the relative humidity.

16. The FAVC apparatus of claim 1, wherein the system circuitry is configured to not restrict ventilation or to not terminate ventilation when (1) the temperature of fresh air is below 70° F. and above 25° F. and (2) the relative humidity is below 50%.

17. The FAVC apparatus of claim 1, wherein the system circuitry is configured to not restrict ventilation when (1) the temperature of fresh air is above 70° F. and below 90° F. and (2) the relative humidity is below 50%.

18. The FAVC apparatus of claim 1, wherein compressor activity is required for ventilation when the temperature of fresh air is above 85° F.

19. The FAVC apparatus of claim 1, wherein the system circuitry is configured to reduce ventilation when the temperature of fresh air is above 90° F.

* * * * *